United States Patent [19]

Rosenfeld

[11] 4,036,365

[45] July 19, 1977

[54] LINEN SORTER WITH A CONVEYOR MOUNTING INDIVIDUAL LINEN PICKERS

[75] Inventor: Howard Rosenfeld, New York, N.Y.

[73] Assignee: Burlington Industries, Inc., Greensboro, N.C.

[21] Appl. No.: 569,570

[22] Filed: Apr. 18, 1975

[51] Int. Cl.[2] ..... B07C 5/34

[52] U.S. Cl. ..... 209/73; 209/111.5

[58] Field of Search ..... 209/111.5, 111.6, 73, 209/74, 111.7; 294/64 R, 64 A, 64 B

[56] References Cited

U.S. PATENT DOCUMENTS

| | | | |
|---|---|---|---|
| 3,313,941 | 4/1967 | Marks | 209/111.5 X |
| 3,373,869 | 3/1968 | Burson, Jr. | 209/111.5 |
| 3,438,489 | 4/1969 | Cambornac et al. | 209/111.5 |

*Primary Examiner*—Allen N. Knowles

*Attorney, Agent, or Firm*—Cushman, Darby & Cushman

[57] ABSTRACT

A method, system, and attachment for conveying sorting articles, such as laundry or the like whereby each article is grasped by one of a plurality of separated pickers mounted on a conveyor and moved vertically past a detector which identifies the article and causes it to be dropped to fall into the proper one of a plurality of containers over which the pickers then move with the grasped article suspended below the picker. Each article preferably includes as a part thereof a quantity of each of a number of different materials of the type which each produce secondary radiation at a characteristic energy lever when X-ray, gamma or other radiation impinges thereon, the combination of materials forming a code uniquely identifying the article.

21 Claims, 4 Drawing Figures

LINEN SORTER WITH A CONVEYOR MOUNTING INDIVIDUAL LINEN PICKERS

BRIEF DESCRIPTION OF THE PRIOR ART AND SUMMARY OF THE INVENTION

The invention relates to a system and method in which articles such as laundry or the like are conveyed past a detector, and subsequently sorted.

Many industrial and process situations occur in which it is necessary to separate, identify, count, tabulate and/or sort different types of articles which are presented to a given location. One way to accomplish this function is to station one or more workers who visually differentiate articles as they are presented singly or in batches and either manually or with the aid of machinery place the articles in different locations or en route to different locations according to a desired sorting program. However, manual or machine aided sorting of this type has a number of obvious drawbacks.

First, the job is a tedious and often difficult one requiring exactness, a high degree of dexterity and intelligence, but one in which the pay is usually low and the working conditions undesirable. Accordingly, it is often difficult to attract and hold workers who can satisfactorily perform these operations. Further, the speed at which human workers can separate, recognize an article, count, tabulate, and cause its proper routing is limited.

The handling of large numbers of individual different types and pieces of used, dirty laundry returned to a linen supply or a central plant for cleaning is a particularly complicated problem. Laundry is usually received in large sacks or other containers from each customer. It is desirable to separate the laundry into groups of like pieces since the cleaning treatment for the various pieces may vary considerably, as to size of piece, color, soil level, etc. The numbers are large particularly for a linen supply laundry, a central hospital laundry or a nursing home laundry.

A modest sized plant handles as much as 100,000 soiled pieces in an 8 hour day - all handled manually today. The condition of most of the soiled linen after averaging a week's aging of the soil from restaurants, hospitals, and nursing homes is not only disagreeable to handle, because of odors, etc., but also dangerous to health.

Further, it is desirable to have an accurate count of the various pieces which are returned by each customer to make sure that all, or even most, of the washable textile products which have been furnished to the customer, are, in fact, being used and returned. At best, most medium and large linen supply plants and central hospital laundries are only able to sort for the different types of washing and not count at all.

Because of the lack of a count of the return of soiled textile products, or, at best, an inaccurate manual count, the average useful life (use cycles) of the linen supply or central laundry textile products used in hotels, hospitals, etc., is less than half the potential wear life where there is tight inventory control. Such control is possible only by accurate counting of soiled linens. Pilferage and willful destruction of these textile products occur where controls do not exist, and they cannot exist without accurate counting.

Further, without counting, maximizing the use of inventory is impossible, necessitating the total inventory in use to be at best twice normal requirements if proper inventory flow information was available. Accurate information re inventory use requires two accurate counting points - at present, only one at best exists, at point of delivery of the clean linen to the user.

Laundry flows in a closed circuit which includes the use of the textile products (e.g., in a hospital or hotel), the pick up and transportation of the now soiled textile products to a central laundry plant, the checking in (separating into separate pieces), identification, counting, recording count, and then sorting for the laundry process by color, size of piece, soil level, laundring, and then reassembling for reshipment, where the numbers of pieces of each kind is supposed to be determined by the soil count picked up and then delivery to point of use, storage for reuse at place of use (hospitals, hotels, etc.) and finally actual use. At the moment the only accurate count is the clean count at either laundry delivery platform or in at users (hotel) receiving platform.

Many techniques have been developed in the past for identifying articles which are presented to a detecting station and for routing the articles or taking other appropriate action automatically in view of the identity of the article. Many existing systems sense the identity of an article passing a sensing station with optical techniques, for example sensing the light reflected from a coded member attached to the articles comprising a plurality of variable width bars or the like. All optical techniques, however, requires a predetermined orientation of the code member with regard to the sensor. Such an orientation is difficult, if not impossible, to obtain with regard to articles of laundry and the like in which any coded member or tag attached thereto is necessarily presented in a random orientation and may be covered by portions of the article.

Other techniques used in the past include electrical or mechanical techniques which cause perturbations of a uniform field, for example with metal particles or tags. Passive and active circuits can also be incorporated into the tag and detected.

These techniques are not likely to be successful for sorting laundry in part because of at least occasional other metal particles moving past the field of view. Further, the tags are in general, too expensive to be practical in a system where a large number of articles must be sorted. Resonant tags require either orientation or a complicated sensor to eliminate the need therefore. Including enough radio-active material to detect its presence in the pieces of laundry is not only expensive, but might present a health hazard as well. Other detecting techniques have similar drawbacks.

Another technique which has been used in the past for identifying articles utilizes the well-known phenomena that certain materials respond to impingement of X-ray, gamma ray or similar radiation by producing secondary radiation, often termed fluorescense, having a characteristic energy level and a characteristic wave length which can be determined to identify the material. For example, the U.S. Pat. to Edholm No. 2,957,079, describes a technique and device for detecting coded labels in which X-ray, gamma, or other radiation is impinged upon labels on articles moving past the source and the secondary radiation directed to a crystal which produces diffraction which can be analyzed to determine the specific material. Various combinations of materials can be employed in the label to provide a code uniquely identifying the passing article.

One of the difficulties of the system described in Edholm is that it is not fully satisfactory for a system such as required for laundry coding and sorting whereby the labels will be randomly oriented with respect to the detector and source and will often be covered by portions of the article. Further, either multiple crystals or rotation of a single crystal during passage of each tag are required to sweep the frequency band of the materials coding the tag. The difficulties of rotation and using multiple crystals increase with speed and are very difficult at high speeds such as required for laundry sorting.

A copending application entitled "Linen Sorter" filed Apr. 4, 1975, Ser. No. 565,133 now abandoned, describes a system, apparatus, method and attachment for sorting articles, and particularly for sorting laundry articles whereby a part of the article includes a quantity of at least one material, and preferably a plurality of different materials, which each produce characteristic secondary radiation at predetermined energy levels in response to impinging X-ray radiation. The combination of present and absent materials forms a code uniquely identifying the article. Each different material in effect constitutes a binary digit with the presence indicating one value, for example one, and the absence indicating the other value, for example zero. The articles are conveyed in random orientation past the source of radiation so that a conventional detector receives the secondary radiation from the article and produces electrical output pulses having an amplitude proportional to the fluorescent energy received. A semiconductor, energy dispersive energy detector is preferred, but a gas tube detector may possibly be used alternatively. Such detector is connected to a conventional multi-channel analyzer of the type which produces a series of electrical outputs proportional to the number of pulses received at each of a plurality of energy levels. The number of pulses produced at each energy level determines whether a given material is present as a part of the article. The U.S. Pat. to Hendee et al, No. 3,102,952, describes a system of this type for analyzing multi-component materials by X-ray fluorescence. The output signal of the detector is then used to control movement of the article in accordance with its identity after is has passed the detector.

The fluorescent material or materials may be dispersed throughout the garment, for example, by printing, spraying or by being included in the fabric finish or dye, if all, or a large portion of, the garment passes the detector in a sufficiently short time. Alternatively and preferably, the material may be formed as part of a label, a tag, a snap, a button or an emblem or the like which can be used also for purposes such as visually identifying a garment wearer or a company or the article. The fluorescent material may be incorporated into thermoplastic threads or a patch which may be sewn or otherwise attached to the article.

This particular technique has a number of substantial advantages. The quantity of material can be incorporated into the articles in a variety of ways. If a tag is employed, the tag can assume any cross-sectional geometry and can be located at any point in the articles. When the article is a garment, the tag can be located, if desired, inside the garment or may be used as a name tag or the like. The material need not be incorporated in quantities which are hazardous on contact with or consumption by humans. The material further is not intrinsically hazardous. The articles can be conveyed past the detector substantially one at a time at a very high rate, for example, 6,000 articles per hour. The materials which are incorporated can be used in very small quantities at reasonable cost, permitting the system to practically be employed even when millions of pieces of laundry must be each coded.

One of the difficulties in such a system, however, is in conveying the pieces individually past the detector and then routing or depositing them at a desired location or according to a desired program. According to the invention of this application as described in detail below, the pieces of laundry are individually picked from a pile and conveyed vertically past a detector assembly, for example as described in the above mentioned copending application. After movement past the assembly, the pieces move horizontally over a series of bins or chutes and are released at the proper time to fall into the desired bin or chute.

Each picker preferably includes a pneumatic tube having at an exposed end a pressure below atmospheric so that when the tube is lowered into a pile of laundry, the tube picks up at least one piece and is then raised. As the tube rises a pair of pins extending out of the tube and engaging the material held over the tube end, try to separate. If they can move more than a slight distance, indicating more than one piece is held a switch is closed causing the picker to drop its load.

Many other objects and purposes of the invention will be clear from the following detailed description of the drawings.

DETAILED DESCRIPTION OF THE DRAWINGS

Figure 1:
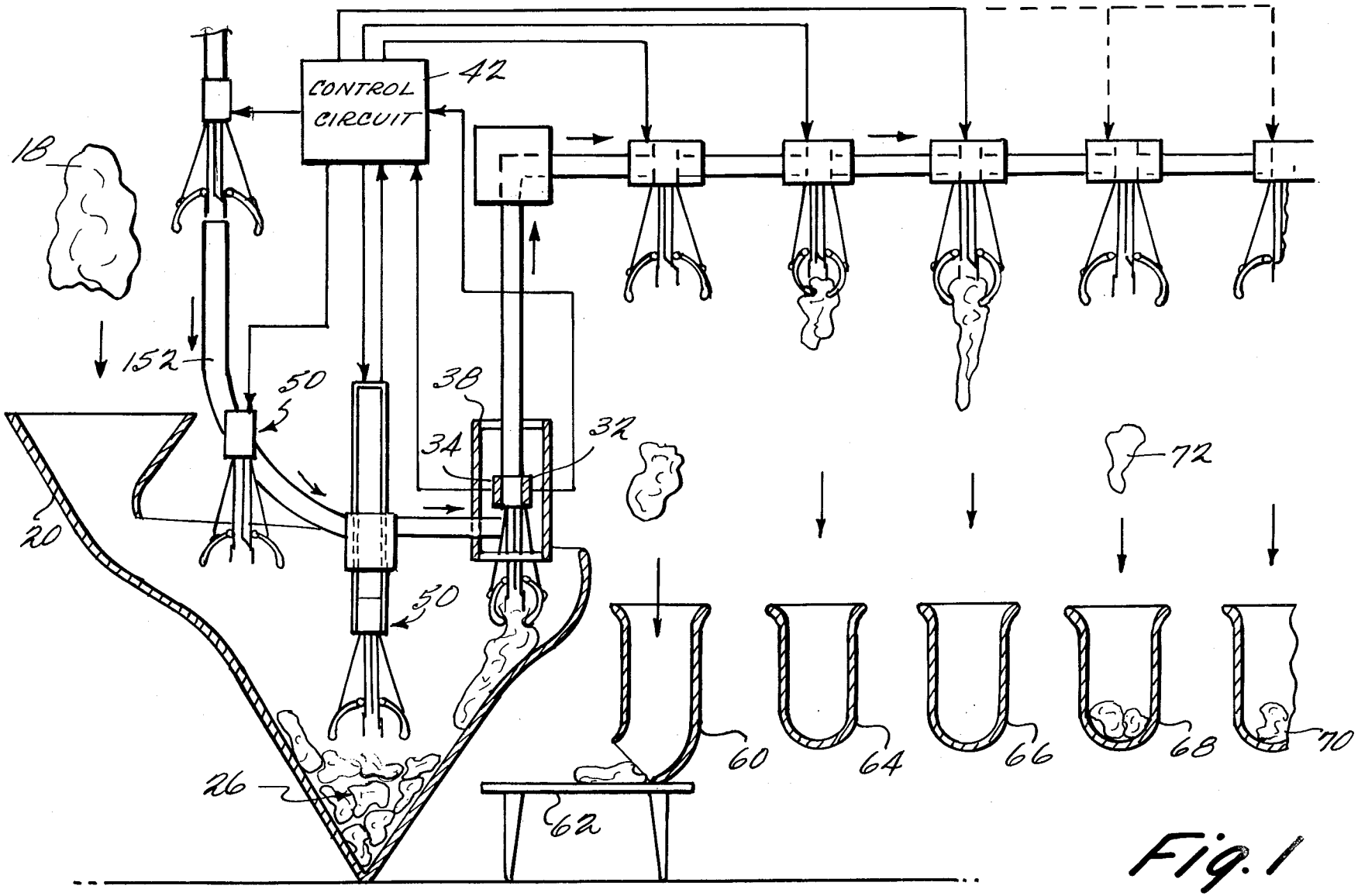
FIG. 1 shows a sectional, side schematic view of a first embodiment of this invention for conveying articles such as laundry during detection, counting and sorting.
Figure 2:
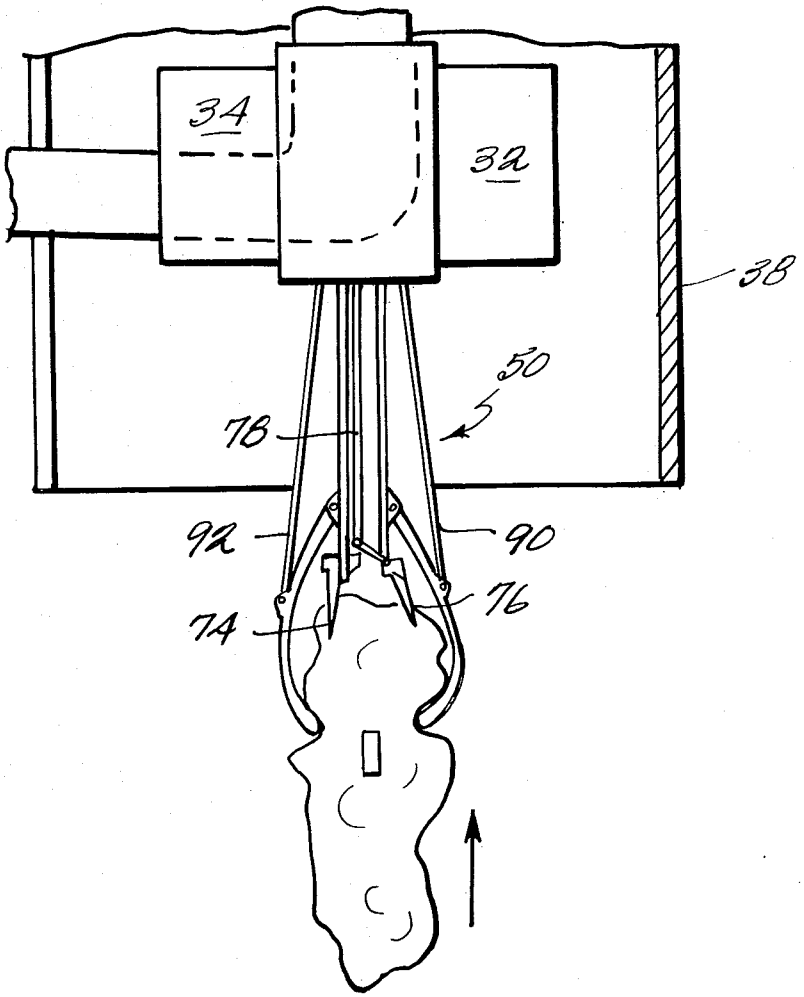
FIG. 2 shows a detailed view of a picker in the embodiment of FIG. 1 moving past a detector assembly.

Reference is now made to FIGS. 1 and 2 which illustrate a first embodiment in which articles to be sorted such as towels, sheets, garments and the like are deposited manually or automatically from a sack 18 into a cone-shaped chute or hopper 20 to fall onto a pile of laundry 26. The articles of laundry are then individually picked up and conveyed past a detector station which may, for example, comprise a radiation source 32 and a conventional solid state detector 34. Detector 34 and source 32 are housed within a housing 38 which helps to shield the exterior thereof from stray radiation.

Radiation source 32 may, for example, be any conventional radiation source of the type which will produce suitable X-ray fluorescence; Americium 257 and Gadolinium 153 are believed to be suitable and are available at a reasonable cost. The source characteristic energy should be roughly twice the highest fluorescence energy characteristic of the tag elements employed. The X-ray radiation produced by source 32 passes through each article of laundry 40 which passes source 32 randomly oriented. Each such article has disposed therein as a part thereof a quantity of material which produces secondary radiation of fluorescense at a predetermined energy level in response to impinging X-ray radiation. This material may be formed as a tag attached to the article 40 or may be dispersed throughout the entire article. Preferably at least two different types of materials are included in each article and the presence or absence of given type of material in effect represents a binary digit of a code identifying the article.

The secondary radiation given off by the material incorporated within the article of laundry 40 is detected by conventional solid state detector 34 which preferably includes a multi-channel analyzer which produces a series of electrical signals proportional to the number of pulses at each channel. While the intensity of the received secondary radiation varies inversely with the separation between source and material, this is compensated at least in part by the fact the material further from the source will remain longer in the radiation path which spreads out from the source. Such devices are conventional and are available commercially. Thus, detector 34 produces an electrical signal which indentifies the article 40 passing thereby. This electrical signal is applied to a conventional control circuit 42, which may include a conventional mini-computer or the like and which ascertains the elements present by consideration of the outputs of the analyzer channels. The circuit 42 also produces a suitable output control signal controlling subsequent movement of the article to route it as illustrated in FIG. 1 to a location whereby it can be subsequently processed and further provides a count of the number of articles of each type passing detector 34 and source 32.

Even if two or more tags should move past detector 34 at substantially the same time that condition can be sensed and dealt with. Since each of the articles includes roughly the same quantity of one particular material, then the number of pulse counts produced by detector 34 with respect to that material indicates the number of articles whih are simultaneously passing detector 34 since the number of counts will be doubled when the quantity of that material passing the detector 34 is doubled by simultaneous passage of two articles.

Figure 3:
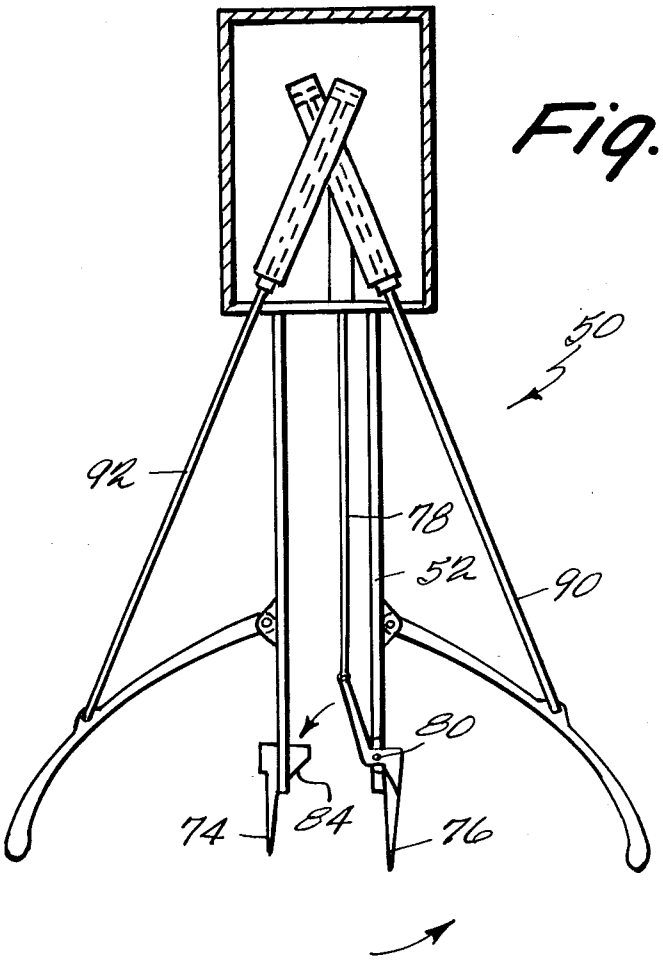
FIG. 3 shows a detailed view of a picker.

The materials can be incorporated into the various articles in several ways. A tag may be attached to each of the articles and can be used as a name tag, as a button, or in any other suitable configuration. The tag may be formed of a plurality of threads, for example each including conventional thermoplastic material incorporating therein a suitable fluorescence material. Any of a number of fluorescence materials can be used in the system depending upon the amplitude of the signals they produce and their relative cost. Suitable tag elements includes the following:

barium oxide
ceric oxalate
lanthanum oxide
praseodymium oxide
neodymium nitrate
samanium oxide As indicated above, linen or other articles of a similar nature are deposited in a conical chute or hopper 20 and fall to the bottom thereof in a large pile. Individual pieces of laundry are picked from this pile by individual picker assemblies 50 which are preferably identical and which are depicted schematically in FIGS. 1–3. Each picker 50 is conventionally mounted for movement at fixed separations along a closed loop of track 152 which has both vertical and horizontal sections. Each picker 50 in turn passes over the bottom of the hopper or chute 20 and is moved vertically downward in response to electrical signals provided by control circuit 42 until it contacts a piece of laundry and more particularly until a portion of that piece is drawn over the open end of tube 52 as can be seen in FIGS. 2 and 3.

Tube 52 is connected to a source of pressure below atmospheric pressure (not shown) so as to draw a portion of the linen piece into the open end of tube 52. When the linen piece covers that end, the resulting drop in air flow into the open end of the tube 52 can be easily detected and a signal produced which indicates to the control circuit that a piece of laundry has been picked and that the picker assembly can now be moved vertically upwards. Any suitable mechanical arrangement for effecting up and down movement of picker 50 with respect to track 152 can be employed. If an individual picker 50 does not grasp a piece of laundry, such condition can be easily detected from the air flowing into the open end of vacuum tube 52 and the cycle of downward movement is repeated for another attempt to pick up a piece of laundry.

The pieces of laundry which are held by each of the individual pickers 50 pass, one at a time, and at a fixed separation, through housing 38 and between source 32 and detector 34 to produce an electrical signal as described above and in the copending application which is applied to control circuit 42 and which indicates the identity of the piece of linen passing therebetween.

After passage through housing 38 between source 32 and detector 34 the individual picker units 50 move along a horizontal section of track 152 and, under the control of circuit 42, open at the appropriate time to permit the grasped piece of linen to drop by gravity into an appropriate container, chute, bin of the like. Each such container receives like pieces of linen. The first container 60 preferably receives pieces of linen which have not been identified within the desired confidence limits or which do not have a tag. These articles are directed onto a table 62 from which they can be manually handled. Those pieces without tags can then be retagged and redeposited in the system or otherwise manually handled. Containers 64, 66, 68, and 70 receive like articles as can be seen from the schematic depiction of FIG. 1 in which a piece of linen is shown falling from gravity into container 68.

Utilizing a mechanical picker system of this sort in which the linen pieces are suspended during both detection and sorting has a considerable advantage over pneumatic system, a system in which the linen articles move on a belt, etc. Since the articles are held at one end as they move through the housing 38, there is little danger of clogging within the passage way between source 32 and detector 34. It is desirable to maintain this gap as small as possible, for example 4 inches, so that sufficient radiation will impinge upon the detector to produce a signal having a high degree of reliability. Further, the linen pieces, suspended as they are vertically, can vary greatly in size and will still fall into the right containers. With mechanical pickers the separation between individual pieces of laundry as they move through the system can be kept within precise limits so that the pieces of linen fall with a high degree of certainty at the desired location for further processing.

Reference is now made to FIG. 3 which illustrates a detailed schematic of the end of one picker assembly 50 which seizes the individual pieces of laundry. As mentioned briefly above, as the picker 50 assembly passes through or down into the chute or hopper 20, a vacuum within tube 52 draws a portion of the cloth over the open end of tube 52, triggering an upward movement of picker 50. Pins 74 and 76 extend outward from the open end of tube 52 for example, for about ½ inch. As the cloth of the individual linen piece is drawn over the open end of tube 52, pin 74 and 76 engage the cloth adjacent to that end. As picker 50 moves upward, rod 78 is released permitting pin 76 to rotate about pivot 80. If two or more individual pieces of laundry are being held over the open end of tube 52, one piece on pin 74 and one piece on pin 76, then those pieces will not prevent pin 76 from pivoting so that contact 82 operates switch 84, producing an electrical signal indicating that two or more pieces of laundry are being held. This causes the control circuit to produce a signal which releases the vacuum within tube 52 and permits the two pieces of laundry to fall back to the bottom of hopper or chute 20. If the switch 84 is not activated shortly after picker 50 begins its upward movement after grasping a piece of laundry, rods 90 and 92 are moved to cause pincher arms 94 and 96 to move in the direction of the arrows and firmly grasp the piece of laundry as can be seen in FIG. 2. At this point the vacuum within tube 52 is no longer required to hold the piece on picker 50 and can be released.

This particular conveying system can be operated at a relatively high rate of speed. With the conveyor moving at 5 feet per second, 6,000 pieces of laundry can be separated, counted, identified, tabulated and sorted in each hour. A separation for the pieces of three feet is believed to be satisfactory, irrespective of the size of the individual laundry pieces. Rather than using a single track on which the picker units 50 continuously move along a closed path, it is alternatively possible to provide another arrangement with the linen being transferred from a fixed position picker which picks the laundry up from a pile and transfers it to a holder on a conveyor which carries it through the detector assembly and then along a horizontal path over a plurality of containers dropping it at the desired time to cause it to fall at the correct location.

Many other changes and modifications of this invention can, of course, be carried out without departing from the scope of the invention. Accordingly, that scope is intended to be limited only by the scope of the appended claims.

What is claimed is:

1. A system for sorting articles at least some having attached as a part thereof a quantity of at least one material which produces secondary radiation at a predetermined energy level in response to impinging radiation and which forms a code identifying the article comprising:

a source of radiation, a plurality of picker means each including means for grasping and releasing an article, a hopper for receiving said articles, means for conveying each said picker means over said hopper so as to grasp an article therein and conveying an article grasped thereby randomly oriented past said source and thereafter past a plurality of article locations, a detector for receiving said secondary radiation and producing an electrical output signal indicating the material attached to said article and accordingly identifying the article, and means connected to said detector for causing each picker means to release a grasped article after movement past said source and detector at one of said locations in accordance with said output signal.

2. A system as in claim 1, wherein each picker means includes means for detecting when multiple articles are grasped and releasing said multiple articles to fall back into said hopper prior to movement past said source when said multiple articles are detected.

3. A system as in claim 1, wherein said articles grasped hang vertically below said picker means and move vertically past said source.

4. A system as in claim 3 further including a plurality of separated article containers each defining one of said locations and wherein said conveying means includes means for conveying said picker means, with grasped articles hanging vertically therefrom, over each of said containers.

5. A system as in claim 4, wherein said containers each receive like articles.

6. A system as in claim 1 wherein said articles are pieces of laundry and including a plurality of said pieces.

7. A system for sorting articles at least some having attached as a part thereof a quantity of at least one material which produces secondary radiation at a predetermined energy level in response to impinging radiation and which forms a code identifying the article comprising:

a source of radiation, a plurality of picker means each including means for grasping and releasing an article, means for conveying said picker means and an article grasped thereby randomly oriented past said source and thereafter past a plurality of article locations, a detector for receiving said secondary radiation and producing an electrical output signal indicating the material attached to said article and accordingly identifying the article, and means connected to said detector for causing each picker means to release a grasped article after movement past said source and detector at one of said locations in accordance with said output signal.

8. A system as in claim 7, wherein said source is Americium 257.

9. A system for sorting articles at least some having attached as a part thereof a quantity of at least one material which produces secondary radiation at a predetermined energy level in response to impinging radiation and which forms a code identifying the article comprising:

a source of radiation, a plurality of picker means each including means for grasping and releasing an article, means for conveying said picker means and an article grasped thereby randomly oriented past said source and thereafter past a plurality of article locations, a detector for receiving said secondary radiation and producing an electrical output signal indicating the material attached to said article and accordingly identifying the article, said detector including a solid state, energy dispersive semiconductor X-ray sensor, means for producing a series of electrical output pulses at each of a plurality of energy levels, each associated with a quantity of different material and means for counting the number of pulses produced at each of said energy levels to determine whether a given material is present as part of said article, and means connected to said detector for causing each picker means to release a grasped article after movement past said source and detector at one of said locations in accordance with said output signal.

10. A system for sorting articles at least some having attached as a part thereof a quantity of at least one material which produces secondary radiation at a predetermined energy level in response to impinging radiation and which forms a code identifying the article comprising:

a source or radiation, a plurality of picker means each including means for grasping and releasing an article, means for conveying said picker means and an article grasped thereby randomly oriented past said source and thereafter past a plurality of article locations, a detector for receiving said secondary radiation and producing an electrical output signal indicating the material attached to said article and accordingly identifying the article, said detector including means for producing an output signal indicating, from the number of pulses counted at at least one energy level, the number of articles passing said source at that time, and means connected to said detector for causing each picker means to release a grasped article after movement past said source and detector at one of said locations in accordance with said output signal.

11. A system for sorting articles at least some having attached as a part thereof a quantity of at least one material which produces secondary radiation at a predetermined energy level in response to impinging radiation and which forms a code identifying the article comprising:

a source of radiation, a plurality of picker means each including means for grasping and releasing an article, means for conveying said picker means and an article grasped thereby randomly oriented past said source and thereafter past a plurality of article locations, a detector for receiving said secondary radiation and producing an electrical output signal indicating the material attached to said article and accordingly identifying the article, said detector including means for counting the number of articles passing said source, and means connected to said detector for causing each picker means to release a grasped article after movement past said source and detector at one of said locations in accordance with said output signal.

12. A system for sorting pieces of laundry at least some having attached as a part thereof a quantity of at least one material which produces secondary radiation at a predetermined energy level in response to impinging radiation and which forms a code identifying the article comprising:

a plurality of laundry pieces, a source of radiation, a plurality of picker means each including means for grasping and releasing a piece of laundry, means for conveying said picker means and a piece of laundry grasped thereby randomly oriented past said source and thereafter past a plurality of piece locations, a detector for receiving said secondary radiation and producing an electrical output signal indicating the material attached to said piece of laundry and accordingly identifying the piece of laundry, means connected to said detector for causing each picker means to release a grasped piece after movement past said source and detector at one of said locations in accordance with said output signal, and a tag attached to each of said pieces of laundry incorporating at least quantities of first and second different materials.

13. A system as in claim 12, wherein each tag is formed of thermoplastic material.

14. A system of sorting articles at least some having attached as a part thereof a quantity of at least one material which produces secondary radiation at a predetermined energy level in response to impinging radiation and which forms a code identifying the article comprising:

a source of radiation, a plurality of picker means each including means for grasping and releasing an article, including a tube adapted for a pressure below atmospheric pressure and having an open end onto which said article is drawn, and held while said tube has a pressure below atmospheric pressure, first and second pins extending outwardly from said open end to engage said article, means for pivoting one of said pins to increase the distance therebetween, and switch means coupled to said one pin for producing a signal indicating a grasping of a multiplicity of articles when said one pin pivots further than a predetermined distance, means for conveying said picker means and an article grasped thereby randomly oriented past said source and thereafter past a plurality of article locations, a detector for receiving said secondary radiation and producing an electrical output signal indicating the material attached to said article and accordingly identifying the article, and means connected to said detector for causing each picker means to release a grasped article after movement past said source and detector at one of said locations in accordance with said output signal.

15. A system as in claim 14, wherein said picker means further includes a pair of grasping arms having ends extending beyond said open end and means pivotably mounting said arms for movement between a withdrawn position and a position grasping said article.

16. A method of sorting textile articles or the like comprising the steps of:

individually grasping and suspending each of said articles from a picker, passing, substantially one at a time, said articles, randomly oriented, at least some having as a part thereof a quantity of at least one material which produces secondary radiation in response to impinging radiation, and which forms a code identifying the article past a source of said impinging radiation so that said secondary radiation is produced, impinging X-ray radiation onto said articles, detecting discretely each of the secondary radiations and producing a signal indicating the passing articles, and dropping said article at one of a plurality of locations in accordance with said signal.

17. A method of sorting textile articles or the like comprising the steps of:

individually grasping and suspending each of said articles from a picker, passing, substantially one at a time, said articles, randomly oriented, at least some having as a part thereof a quantity of at least one material which produces secondary radiation in response to impinging radiation, and which forms a code identifying the article past a source of said impinging radiation so that said secondary radiation is produced, detecting discretely each of the secondary radiations and producing a signal indicating the passing articles, including detecting energies of the X-rays emitted by said material, and dropping said article at one of a plurality of locations in accordance with said signal.

18. A system for conveying and sorting articles comprising:

a plurality of picker means for each grasping and releasing an individual linen article, means for detecting and identifying each article, conveying means mounting said picker means at separated locations for moving said picker means along a path whereby said picker means grasp an article, carry that article past said detecting and identifying means and release that article, and control means connected to said detecting and identifying means and to said picker means to cause said picker means to release a grasped article at a location which varies as a function of the identity thereof.

19. Apparatus for grasping an article for conveyance comprising:

a tube adapted for a pressure below atmospheric pressure and having an open end onto which said article is drawn and held while said tube has a pressure below atmospheric pressure, first and second pins extending outwardly from said open end to engage said article, means for pivoting one of said pins to increase the distance therebetween, and switch means coupled to said one pin for producing a signal indicating grasping of a multiplicity of articles when said one pin pivots greater than a predetermined distance.

20. Apparatus as in claim 19, further including a pair of grasping arms having ends extending beyond said open end and means pivotably mounting said arms for movement between a withdrawn position and a position grasping said article.

21. Apparatus as in claim 19, wherein said article is a piece of linen and including said article.

* * * * *